United States Patent [19]

Maezawa et al.

[11] Patent Number: 4,647,239

[45] Date of Patent: Mar. 3, 1987

[54] PAPER LOADING SYSTEM FOR USE IN A PRINTER

[75] Inventors: Tokio Maezawa, Ikoma; Koichi Furukawa, Kashihara, both of Japan

[73] Assignee: Sharp Kabushiki Kaisha, Osaka, Japan

[21] Appl. No.: 752,856

[22] Filed: Jul. 8, 1985

[30] Foreign Application Priority Data

| | | | |
|---|---|---|---|
| Jul. 9, 1984 | [JP] | Japan | 59-143082 |
| Jul. 9, 1984 | [JP] | Japan | 59-143083 |
| Jul. 9, 1984 | [JP] | Japan | 59-143084 |
| Jul. 9, 1984 | [JP] | Japan | 59-143085 |
| Jul. 10, 1984 | [JP] | Japan | 59-143975 |

[51] Int. Cl.[4] ..... B41J 13/16

[52] U.S. Cl. ..... 400/708; 400/126; 271/240; 346/76 PH; 226/199

[58] Field of Search ..... 271/238, 240, 241; 226/199; 400/322, 126, 708, 708.1; 346/76 PH

[56] References Cited

U.S. PATENT DOCUMENTS

| | | | |
|---|---|---|---|
| 3,311,371 | 3/1967 | Zenthen | 271/240 |
| 3,834,505 | 9/1974 | Fowler et al. | 400/126 |
| 4,050,564 | 9/1977 | Carmichael et al. | 400/126 |
| 4,099,484 | 7/1978 | Ohno | 226/199 |
| 4,272,204 | 6/1981 | Quinn, Jr. et al. | 400/708 |

FOREIGN PATENT DOCUMENTS

| | | | |
|---|---|---|---|
| 105381 | 6/1982 | Japan | 400/708 |
| 140181 | 8/1982 | Japan | 400/708 |
| 31788 | 2/1983 | Japan | 400/708 |
| 36477 | 3/1983 | Japan | 400/708.1 |

*Primary Examiner*—William Pieprz

*Attorney, Agent, or Firm*—Birch, Stewart, Kolasch & Birch

[57] ABSTRACT

A paper loading system for use in a printer has a platen and a paper bail mounted with two rollers. A carriage having a projection is provided to move parallelly to the platen. At the free end of the projection, a photodetector is provided to detect an edge of a loaded paper so as to memorize the opposite ends of the loaded paper. When the paper bail is in a pressing position at which rollers are holding the paper on a path of advance of the paper, no engagement is accomplished between the projection and the rollers. But when the paper bail is in a releasing position at which rollers are separated from the path to release the paper, the projection may come into contact with rollers to change the position of rollers. Using the memorized data, the movements of the carriage and the paper bail are controlled to locate the rollers at the opposite side rims of the loaded paper.

13 Claims, 9 Drawing Figures

PAPER LOADING SYSTEM FOR USE IN A PRINTER

BACKGROUND OF THE INVENTION

1. Field of the invention

The present invention relates to a paper loading system for use in a printer and, more particularly, to a system which may locate the opposite side edges of a loaded paper and automatically move and position the bail rollers along the paper bail to approximately opposite side rims of the loaded paper.

2. Description of the Prior Art

In FIG. 1, a prior art paper loading device is shown, which includes a platen 40 rotatably supported by a shaft diagrammatically shown by a chain line 41. Provided under the platen is feed rollers 43*a*, 43*b* and 43*c* which are rotatably mounted on a shaft 42 extending parallel to shaft 41. Feed rollers 43*a*, 43*b* and 43*c* are held against the platen with a predetermined pressure. A paper bail 44 extends parallel to shaft 41 and bail rollers 45*a* and 45*b* are rotatably mounted on paper bail 44. By the pushing force, bail rollers 45*a* and 45*b* move along paper bail 44.

When the bail is moved to a pressing position, bail rollers 45*a* and 45*b* are held against the platen with a predetermined pressure by a suitable spring (not shown) so as to hold a paper between the platen and rollers. When the bail is moved to a released position, bail rollers 45*a* and 45*b* are separated away from the platen so as to release the paper.

After loading a paper, the paper is advanced to a printing position at which the bail, which has been in the released position, is moved to the pressing position so as to hold the paper.

In this case, the bail rollers should be so organized at positions within the width of the loaded paper, and yet at places where the rollers do not affect the printing, such as at opposite side rims of the loaded paper.

In the case where the printing is carried out using different size papers, it is necessary to change the position of the bail rollers each time the paper size is changed. This is usually done manually, and is a cumbersome operation. Therefore, sometimes the operator forgets to move the bail rollers to the proper position.

If the printer is a type which uses ink, such as an ink-jet printer, the proper positioning of the bail rollers is very important. For example, if the bail rollers are positioned away from the loaded paper, the paper may be lifted off from the platen. In such a case, the ink-jet may be spotted on the paper awkwardly, resulting in a deformed character. Also, if the bail rollers are positioned against the printing area of the paper, the rollers may run over the characters just printed, resulting in an ink smear or transfer of the ink onto the rollers and back onto the paper.

Although there are a number of printers equipped with automatic paper feeding apparatus, its advantage is reduced when bail rollers are to be moved manually.

SUMMARY OF THE INVENTION

The present invention has been developed with a view to substantially solving the above described disadvantages and has for its essential object to provide an improved paper loading system for use in a printer wherein the bail rollers can be moved automatically to predetermined positions.

It is also an essential object of the present invention to provide a paper loading system of the above described type wherein the places for positioning the bail rollers are determined by the detection of opposite side edges of the loaded paper.

It is a further object of the present invention to provide a paper loading system of the above described type which can locate opposite side edges of the loaded paper.

In accomplishing these and other objects, a paper loading system for use in a printer which comprises a platen, a paper bail mounted with at least two rollers, and a carriage provided to move parallelly to the platen. A projection is mounted on the carriage with a photodetector is provided at a free end thereof to detect an edge of a loaded paper so as to memorize the opposite ends of the loaded paper. When the paper bail is in a pressing position at which rollers are holding the paper on a path of advance of the paper, no engagement is accomplished between the projection and the rollers. But when the paper bail is in a releasing position at which rollers are separated from the path to release the paper, the projection may come into contact with rollers to change the position of rollers. Using the memorized data, the movements of the carriage and the paper bail are controlled to locate the rollers at the opposite side rims of the loaded paper.

BRIEF DESCRIPTION OF THE DRAWINGS

These and other objects and features of the present invention will become apparent from the following description taken in conjunction with a preferred embodiment thereof with reference to the accompanying drawings, throughout which like parts are designated by like reference numerals, and in which.

DESCRIPTION OF THE PREFERRED EMBODIMENTS

Figure 1:
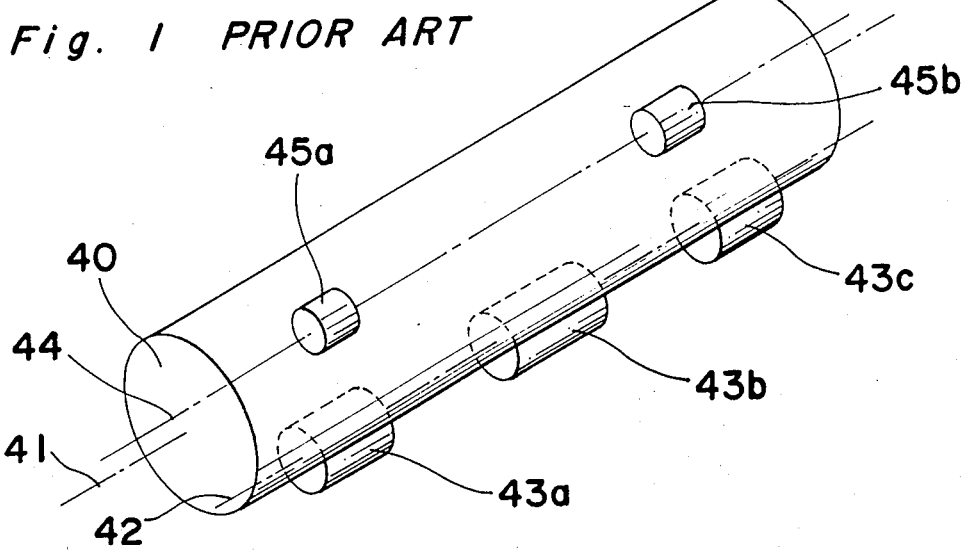
Fig. 1 PRIOR ART
FIG. 1 is a diagrammatic view of a paper loading system used in a printer, according to the prior art.
Figure 2:
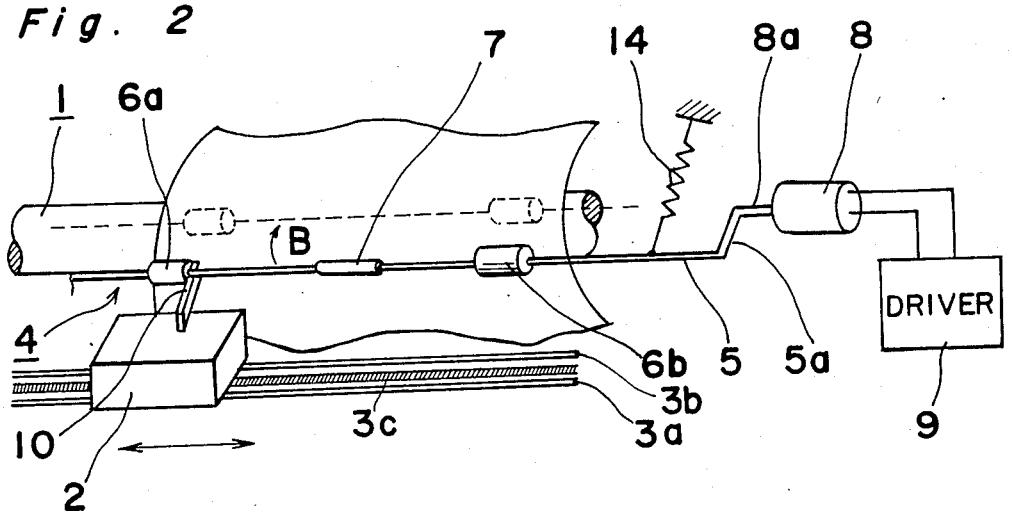
FIG. 2 is a diagrammatic perspective view of a paper loading system according to one embodiment of the present invention.

Referring to FIG. 2, a paper loading system according to one preferred embodiment of the present invention is shown. A reference number 1 designates a platen rotatably supported on a printer body (not shown) and 4 is a paper pressing apparatus for pressing the loaded paper onto platen 1. Paper pressing apparatus 4 include a paper bail 5 having one end 5*a* so bent and connected to a shaft of a rotary solenoid 8. A spring 14 is connected to bail 5 so as to urge the bail in the direction indicated by an arrow B. Mounted on paper bail 5 are bail rollers 6*a* and 6*b* and a spacer 7 between the two bail rollers. Bail rollers 6*a* and 6*b* have the same diameter and spacer 7 has a diameter smaller than that of the bail roller. By the application of external force, bail rollers 6*a* and 6*b*, as well as spacer 7, may move along the paper bail. Also, rollers 6*a* and 6*b* freely rotate.

When solenoid 8 is off, paper bail 5 is rotated in the direction B by spring 14 so as to hold bail rollers 6*a* and 6*b* against platen with a predetermined pressure, as indicated by a dotted line. Thus, a paper may be held against the bail. Paper bail 5 in this position is referred to as a pressing position.

When solenoid 8 is on, paper bail 5 rotates in the direction opposite to arrow B against the urging force of the spring 14, thereby releasing the paper held between platen 1 and rollers 6*a* and 6*b*. Power supply and power cut to solenoid 8 is done by driver 9. Paper bail 5 in this position is referred to as a releasing position.

A reference number 2 designates a carriage installed with a printing head (not shown), such as an ink jet nozzle which shoots droplets of ink towards platen 1. A carriage 2 is movably mounted on a pair of rails 3*a* and 3*b* which extend parallel to platen 1, and its movement is terminated at right- and left-end positions by way of software as stored in a memory 28, which will be described later, and also by way of hardware by right- and left-end stoppers (not shown). An elongated belt 3*c* having black and white stripes depicted with a constant narrow pitch extends between rails 3*a* and 3*b*. A photodetector 3*d* defined by a light emitting diode and a photocell is provided under carriage 2 so as to produce one pulse when photodetector 3*d* moves across one stripe. Accordingly, by the detection of number of pulses generated from photodetector 3*d*, it is possible to detect distance of movement of the carriage. According to a preferred embodiment, photodetector 3*d* is provided in the same plane, cut perpendicularly to rails 3*a* and 3*b*, as that contains probe 10, which will be described below, so that the position of the carriage as monitored by the detection of number of stripes is identical to the position of probe 10. Also, by the detection of rate of generation of pulse, it is possible to detect the speed of the carriage.

Carriage 2 has a probe 10 extending therefrom, and its free end is located close to a path of advance of the paper, such as adjacent the surface of platen 1. When paper bail 5 is moved to the released position, as shown by a real line, probe 10 may come in contact with end face of bail roller 6*a* or 6*b* so as to push and move the bail roller in accordance with the movement of the carriage 2. The free end of probe 10 is provided with a photodetector defined by a light emitting diode 11 for emitting light towards the path of advance of the paper and a photocell 12 for receiving a reflected light (FIG. 3) which are aligned side-by-side vertically, as shown, or horizontally, or in any other angle. Since the reflectivity of paper differs from that of the platen surface, the photodetector, or more particularly photocell 12, generates a signal when it moves past a boundary of the paper loaded on the platen. In place of the photodetector, any other detector may be employed.

Figure 3:
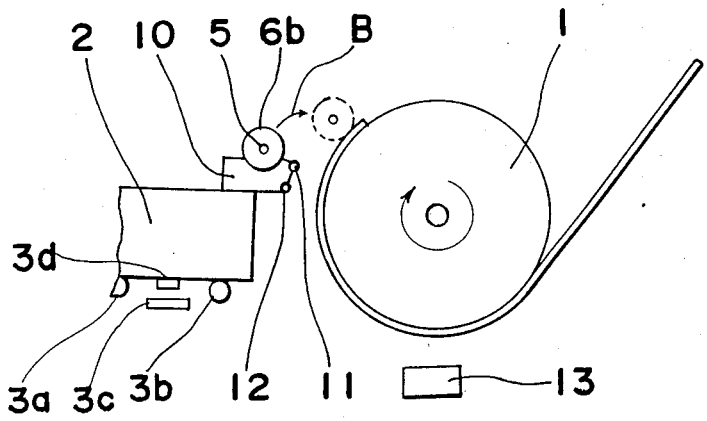
FIG. 3 is a diagrammatic side view of a paper loading system of FIG. 2.

As shown in FIG. 3, another photodetector 13 is provided under platen 1. Photodetector 13 is also defined by a light emitting diode and a photocell and is provided for detecting the insertion of a new paper.

Figure 4:
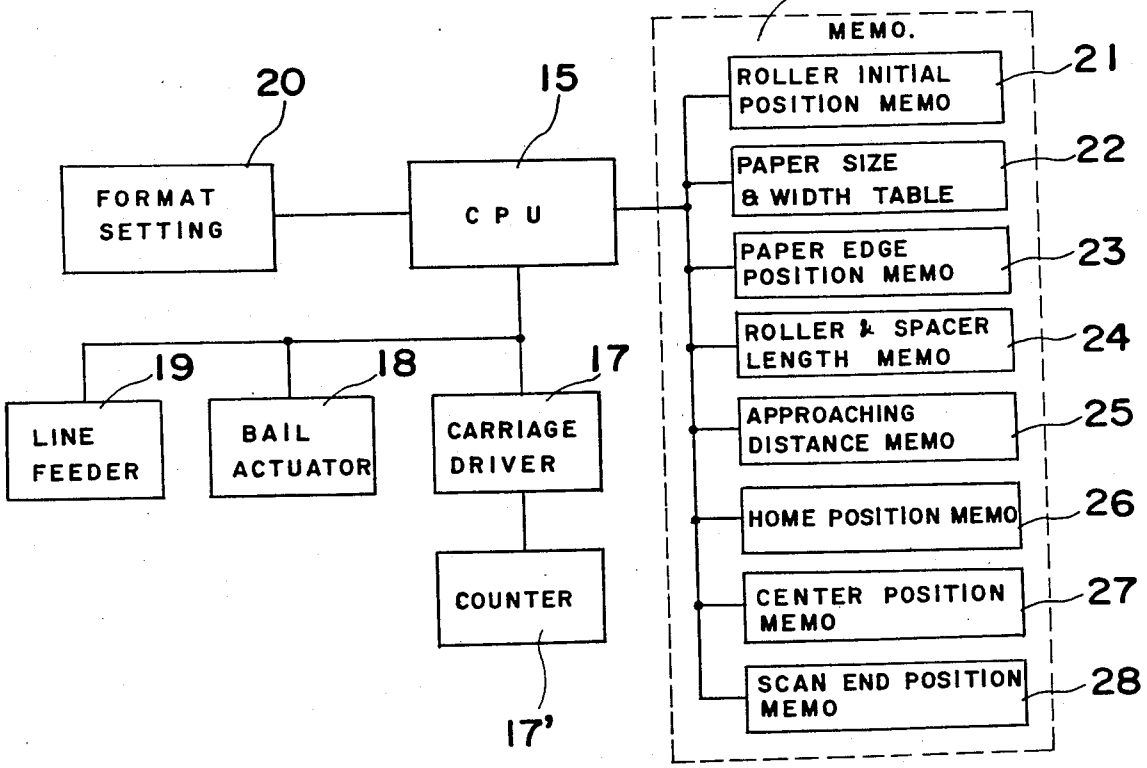
FIG. 4 is a block diagram of a controller for controlling the paper loading system of the present invention.

Referring to FIG. 4 a block diagram of a controller for controlling the paper loading system of the present invention is shown.

A central processing unit (CPU) 15 has an interface I/O device and program control memories. A memory 16 is coupled to CPU 15 for storing various data as explained below.

At memory area 21, data representing the initial position of the bail rollers is stored. When bail rollers 6*a* and 6*b*, as well as spacer 7, are in the initial position, bail rollers 6*a* and 6*b* and spacer 7 are held together and are positioned at the right-hand end of the paper bail with a narrow space provided between the right-hand end face of right roller 6*b* and a most right-hand end position so as to permit the insertion of probe 10 in the narrow space therebetween. It is to be noted that bail rollers 6*a* and 6*b* as well as spacer 7 are first shifted together to the initial position, and then they are separated and shifted to the opposite sides of a loaded paper along the paper bail, in a manner described later.

At memory area 22, a table of various paper sizes, such as A3, A4, A5, B3, B4, B5, etc. with a width listed to each size is stored.

At memory area 23, data of right- and left-hand edge positions of the loaded paper are stored. During the scan of carriage 2, the positions of carriage 2 as detected by belt 3*c* are stored, when probe 10 detects the right- and left-hand edges of the loaded paper.

At memory 24, data of the length of each of bail rollers 6*a* and 6*b* and the length of spacer 7, as measured in the direction parallel to the paper bail are stored.

At memory 25, data of an approaching distance necessary to accelerate carriage 2 from zero to a predetermined constant speed at which the printing is carried out is stored.

At memory 26, data of a home position of carriage 2 is stored. The home position is the position from which carriage 2 starts to move for effecting the printing, and is located further right to the right-hand edge of the loaded paper with the spacing of the approaching distance. Generally, the home position is located close to the right-end position of the scan of carriage 2.

At memory 27, data representing an appropriate position of carriage 2 for detecting the leading edge of the loaded paper is stored. According to the preferred embodiment, the appropriate position is approximately at the center of platen 1.

Finally, at memory 28, data of right- and left-end positions for limiting the movement of carriage 2 are stored.

CPU 15 is also coupled with a format setting device 20 which has a plurality of manually operable switches and keys (not shown). When switches and keys are operated, format setting device 20 produces a signal which requests the reorganization of bail rollers. When switches and keys are operated in another manner, format setting device 20 produces another signal which indicates the change of paper size.

CPU 15 is further coupled with line feeder 19 which controls the driving of platen 1 to advance the loaded paper, solenoid actuator 18 which controls the movement of bail between the pressing position and releasing position, and carriage driver 17 which controls the movement of the carriage 2 along the pair of rails 3*a* and 3*b*.

Figure 5:
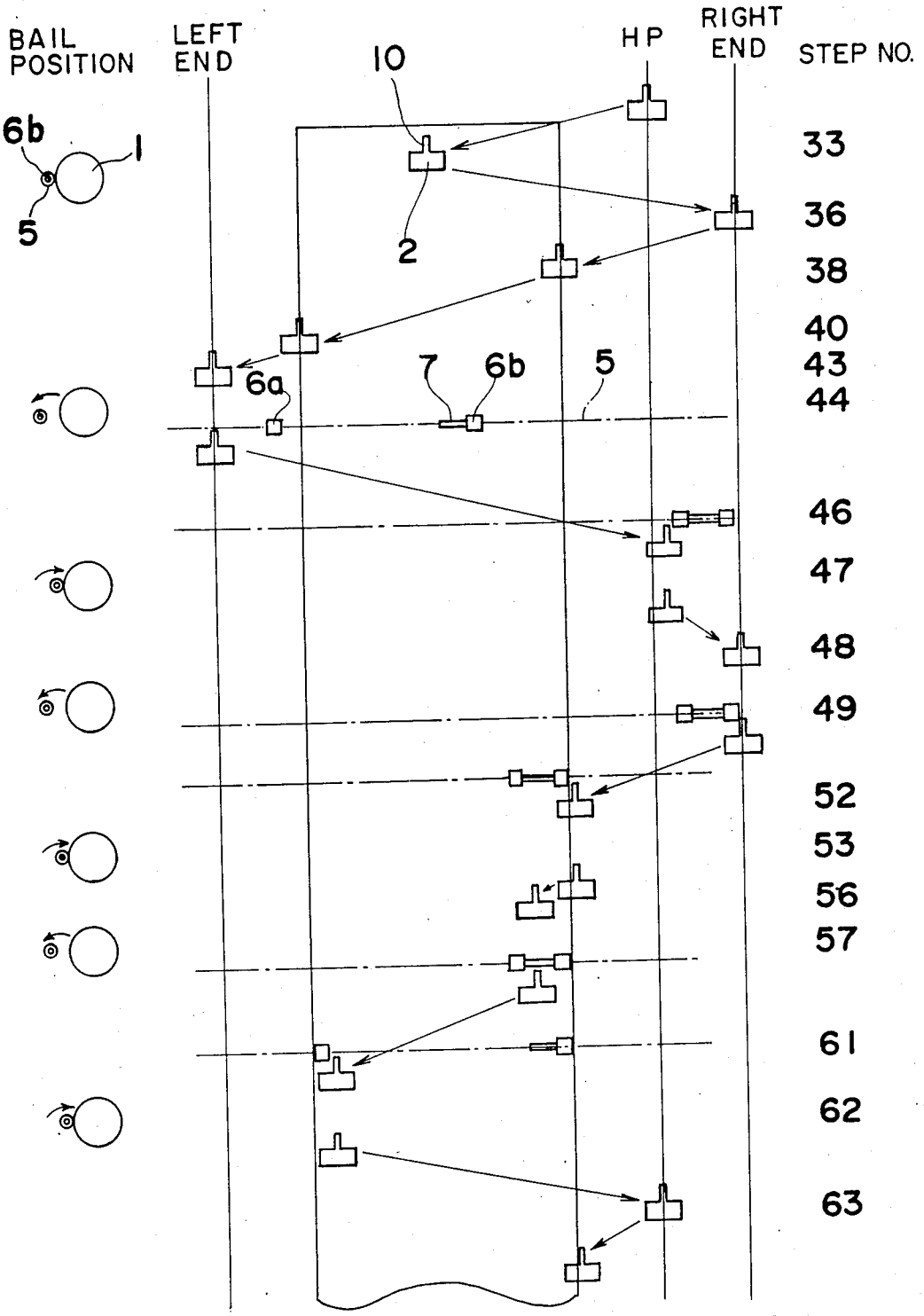
FIG. 5 is a time chart showing the movement of carriage and bail rollers.
Figures 6, 6A:
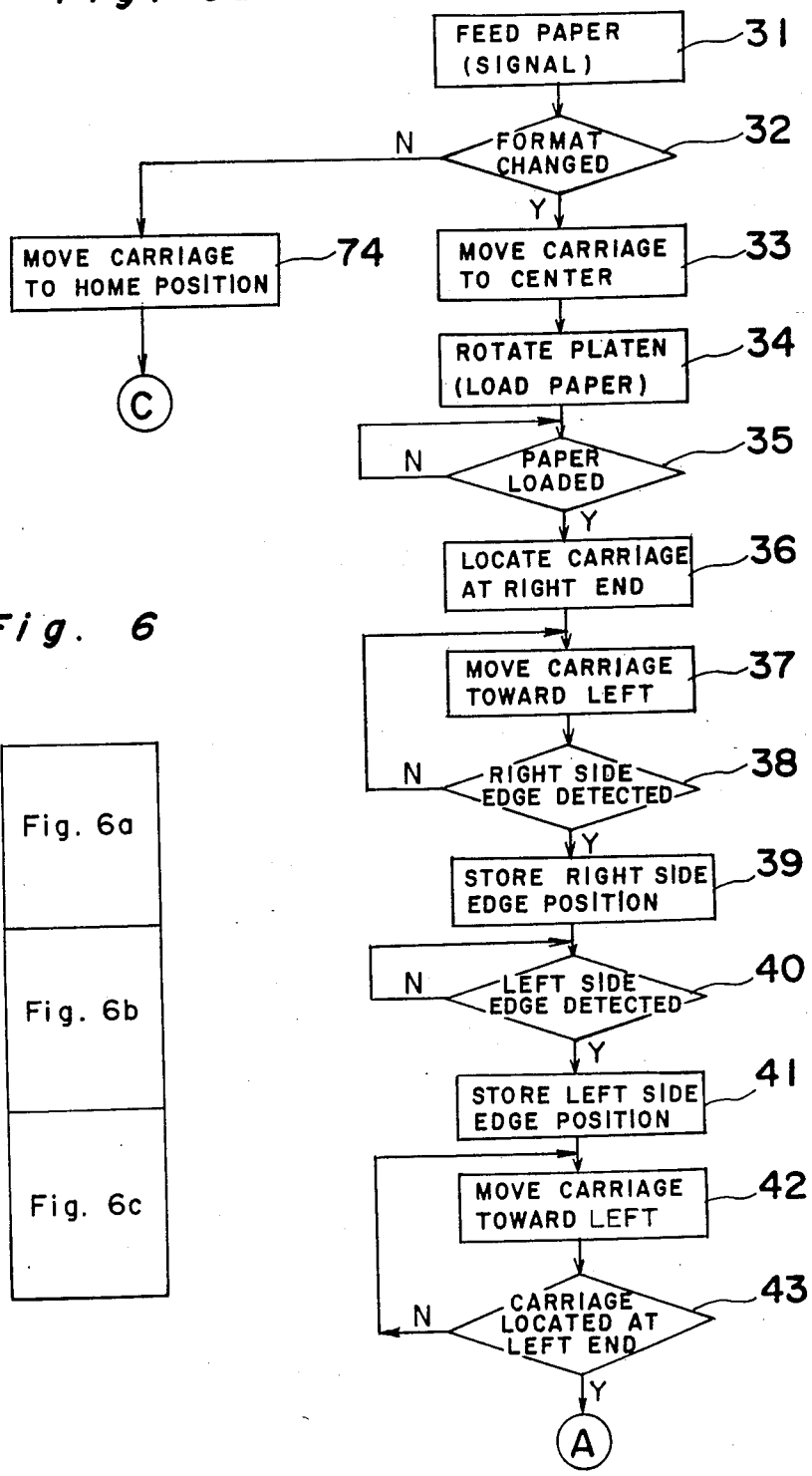
FIGS. 6*a*, 6*b* and 6*c*, taken together as shown in FIG. 6, show a flow chart for controlling the carriage.
Figure 6B:
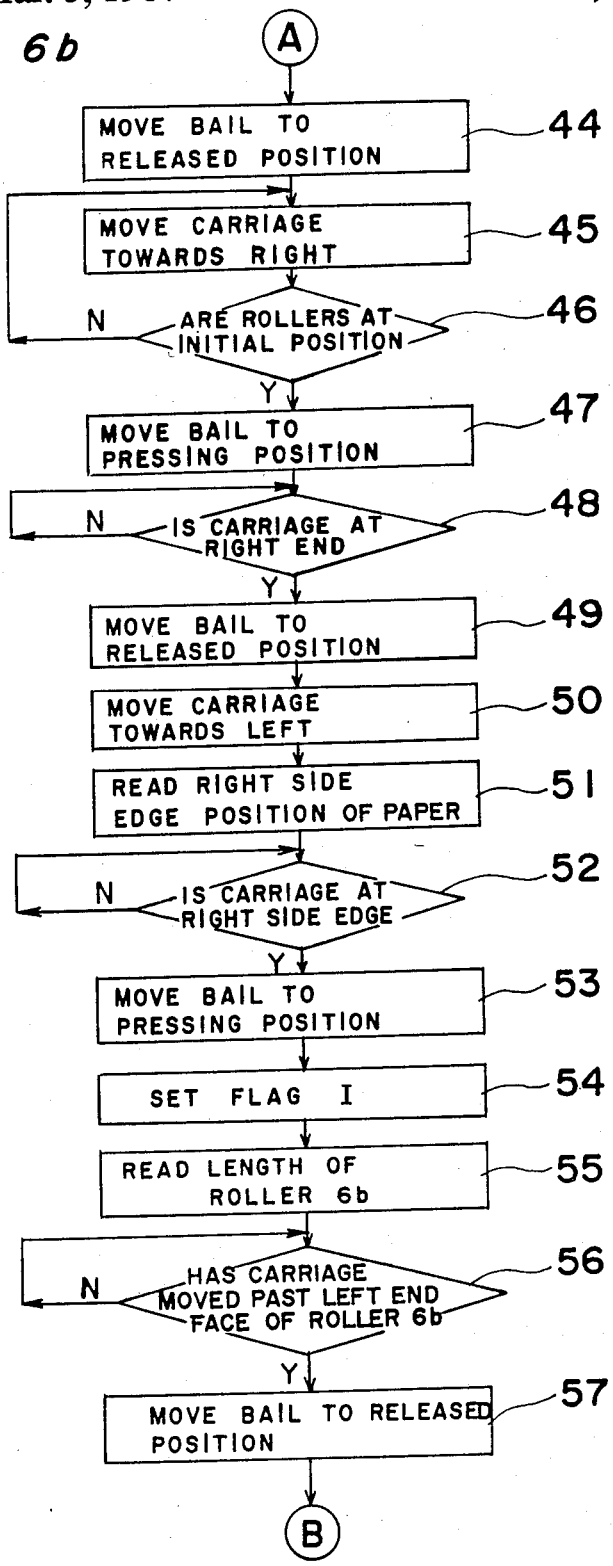
Figure 6C:
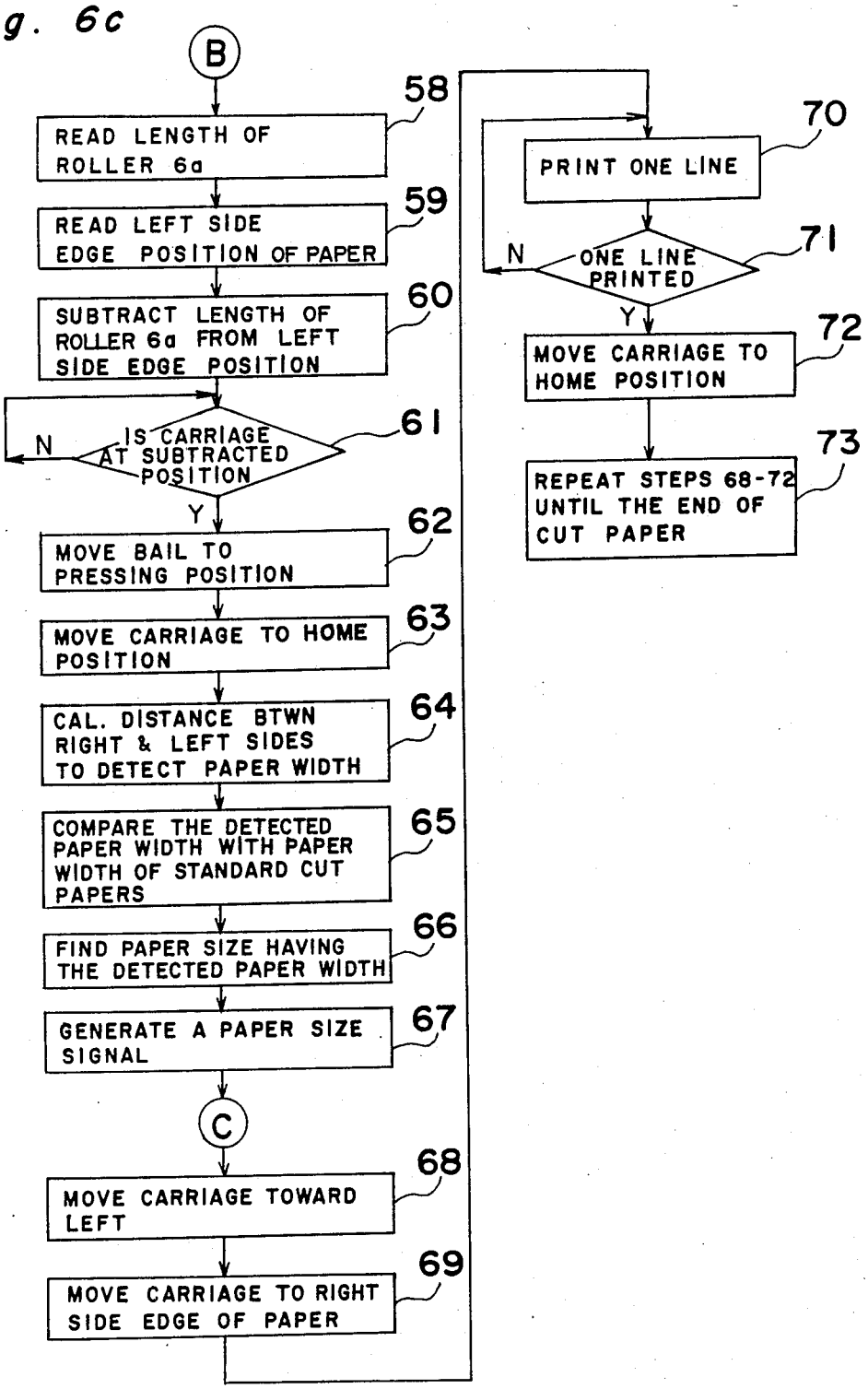

Next, the operation of the paper loading system according to the present invention will be described in connection with FIG. 5 showing a time chart of movement of carriage and bail rollers, and FIGS. 6*a*, 6*b* and 6*c* showing a flow chart for controlling the carriage movement.

The system operation is mainly divided into five operations which are: (1) an operation for loading a paper; (2) an operation for detecting paper position and paper size; (3) an operation for moving rollers to the initial position; (4) an operation for moving the rollers to the opposite sides of the loaded paper; and (5) a printing operation. Each of these operations are described below.

(1) Paper Loading Operation

When a new sheet of paper is fed into a space behind platen 1, platen 1 rotates to roll the paper around platen 1. At step #31, the feeding of a new sheet of paper is detected by the receipt of a paper receipt signal from photodetector 13.

Then, at step #32, it is detected whether or not the size of the paper has been changed; whether or not the inserted position of the paper has been change; and whether or not the reorganization of rollers is requested. When the paper size is change, when the inserted position of the paper is changed, or when the reorganization of rollers is requested, a signal is transmitted from format setting device 20 to CPU 15 for the operation following step #33. If no signal is transmitted to CPU 15 from format setting device 20 at step 32, the program goes to step #74 for moving the carriage to home position and thereafter carrying out the printing operation as indicated in steps #68–#73.

At step #33, carriage 2 is moved to the center as stored in memory 27 and, at the same time, platen 1 is further rotated (step #34) to advance the inserted paper. When the leading edge of the inserted paper is detected by the photodetector defined by light emitting diode 11 and photocell 12, the rotation of platen 1 stops to stop the further advance of the paper, thereby completing the paper loading (step #35). Then, carriage 2 is moved to the right-end position, as stored in memory 28, for the preparation of the next operation.

(2) Paper Position and Paper Size Detecting Operation

From the right-end position, carriage 2 moves towards left (step #37). During the movement of carriage 2, photodetector 3*d*, facing black-and-white striped belt 3*c*, generates a train of pulses. An up-down counter 17′ is provided for counting the number of pulses generated from photodetector 3*d*, so as to locate the position of carriage 2. Then, when probe 10 extending from carriage 2 moves past the right side edge of the loaded paper, photocell 12 generates a first pulse (step #38). In response to the first pulse from photocell 12, the content of the up-down counter is read for detecting the position of probe 10. The detected position, which indicates the position of the right side edge of the loaded paper as measured, e.g., from the right-end position, is stored in memory 23 (step #39).

Carriage 2 further moves towards left. Then, when probe 30 moves past the left side edge of the loaded paper, photocell 12 generates a second pulse (step #40). In response to the second pulse, the content of the up-down counter is read for detecting the position of probe 10. The detected position, which indicates the position of the left side edge of the loaded paper, is stored in memory 23 (step #41).

Thereafter, carriage 2 further moves left (step #42) until it is terminated at the left-end position as stored in memory 28 (step #43).

By the detection of positions of the opposite sides of the loaded paper, the paper loaded position and paper width are detected.

(3) Operation for Moving the Rollers to the Initial Position

After carriage 2 is terminated at the left-end position, bail 5, which has been in the pressing position, is moved to the released position (step #44) so as to permit the contact between the probe and roller. Then, carriage 2 moves towards right (step #45). During the movement, probe 10 contacts and pushes left roller 6*a*, which in turn contacts and pushes spacer 7, and which in turn contacts and pushes right roller 6*b*. The movement of carriage 2 towards right continues until the rollers and spacer are located at the initial position wherein the right end face of right roller 6*b* is located closely adjacent the right-end position so as to provide a narrow space between the right end face of right roller 6*b* and the right-end position (step #46).

The positioning of the rollers and spacer to the initial position can be done by locating the carriage at a position which is spaced from the right end position a predetermined distance equal to the sum of the length of rollers and spacer and the width of probe 10.

When the rollers are shifted to the initial position, a power to solenoid 8 is cut off to permit the rotation of bail 5 to the pressing position by the urging force of spring 14 (step #47). Accordingly probe 10 is freed from rollers.

Then, carriage is further moved to the right-end position (step #48) with no contact with rollers and, thereafter, the paper bail is moved to the released position against the biasing force of spring 14 by the actuation of solenoid 8 (step #49). Accordingly, probe 10 is positioned just on the right-hand side of right roller 6*b*.

(4) Operation for Moving the Rollers to the Opposite Sides of the Loaded Paper

From the right-end position, carriage 2 moves towards left so as to move the rollers and spacer together towards left (step #50). During the movement, a distance between carriage 2 (preferably at a point where probe 10 is provided) and right-end position is continuously monitored by counting the stripes on belt 3*c*. The movement of carriage 2 continues until the position of probe 10 coincides with the position of right side edge of the loaded paper as stored in memory 28. This is done by comparing the present position of carriage 2 with the position of right side edge of the loaded paper (step #52). When the carriage 2 is so moved to a position at which probe 10 coincides with the position of right side edge of the loaded paper, rollers are located at such a position that the right end face of right roller 6*b* is in flush with the right side edge of the loaded paper.

Then, at the next step (step #53), the power to solenoid 8 is cut off to move bail 5 to the pressing position, thereby disengaging the rollers from probe 10. At this moment, flag I is set (step #54), and thereafter, carriage 2 is further moved towards left. At this moment, the positioning of right roller 6*b* is completed.

During the movement of carriage 2 towards left, the length of right roller 6*b* is read from memory 24 thereby locating the position of left end face of right roller 6*b*. This can be done by adding the length of roller 6*b* to the position of right side edge of the loaded paper as stored in memory 23. The position of carriage 2 is compared with the position of left end face of right roller 6*b* (step #56). When carriage 2 has moved past the left end face of roller 6*b*, bail 5 is moved to the released position (step #57), thereby permitting the engagement of probe 10 and left roller 6*a*. Thus, the continuous movement of carriage 2 towards left will shift the left roller 6*a* towards left.

In the meantime, the length of left roller 6*a* is read from memory 24 (step #59), thereby detecting a position where to stop the carriage so as to bring the left end face of left roller 6a in flush with the left side edge of the loaded paper (step #60). This can be done by subtracting the length of roller 6a from the position of left side edge of the loaded paper as stored in memory 23. The position of carriage 2 is compared with the detected position (step #61), and when the position of carriage 2 coincides with the detected position, carriage 2 stops and, at the same time, bail 5 is moved to the pressing position (step #62). Thereafter, carriage 2 is moved back to the home position (step #63). At this moment, the positioning of left roller 6a is completed.

Rollers 6a and 6b are moved to the opposite sides of the loaded paper in the above described manner. Since the diameter of spacer 7 is smaller than that roller 6a or 6b, there will be no engagement between probe 10 and spacer 7.

Thereafter, carriage 2 is moved to the home position. Before the operation proceeds to the printing operation, the paper size of the loaded paper is detected in the following manner.

The positions of the right and left side edges of the loaded paper is read out from memory 23, and a difference therebetween is calculated for obtaining a width of the loaded paper (step #64). Then, using the obtained width as the key factor, the paper size of the loaded paper is searched in a table, as stored in memory 22, listing various paper sizes, such as A3, A4, A5, B3, B4, B5, etc., with the paper width thereof (steps #65 and #66). When the paper size having the obtained width is found, a signal representing the detected paper size is produced for use in the further operation.

In the case where the paper is loaded at any place between the right- and left-end positions by the manual paper feeding, a new home position may be detected at a point located on the right hand side of the right side edge of the loaded paper with a spacing of the approaching distance as stored in memory 25. By setting a new home position each time when the paper is loaded manually, the margins of the paper can be maintained constant even if the loaded position differs. When the new home position is detected, the carriage is moved to the new home position.

(5) Printing Operation

The printing operation starts upon receipt of a print start signal obtained from CPU 15. When the print start signal is generated, carriage 2 moves towards left (step #68) from the home position, and is accelerated to a predetermined speed when it is moved to the right side edge of the loaded paper (step #69). Thereafter, the printing is carried out (step #70) in a known manner. When one line is printed, the carriage returns back to the home position (step #72) and starts the printing of the next line. Steps #68–#72 are repeated until the printing of one cut paper completes.

In the above described embodiment, the home position can be located on the left hand side of the loaded paper. Also, the positions can be measured from the left-end position.

Instead of providing the spacer independently, it is possible to provide a spacer integrally on one or both ends of at least on one roller.

According to the present invention, since the left and right side edges of the loaded paper are detected, the bail rollers can be positioned automatically at the left and right side margins with high accuracy even when the size of the paper changes.

Although the present invention has been fully described with reference to a preferred embodiment, many modifications and variations thereof will now be apparent to those skilled in the art, and the scope of the present invention is therefore to be limited not by the details of the preferred embodiment described above, but only by the terms of the appended claims.

What is claimed is:

1. A paper loading system for use in a printer comprising:

platen for loading a paper thereon and advancing the paper upon rotation of said platen;

carriage means movably provided adjacent said platen to move in a direction parallel to said platen;

position detecting means for detecting the moved position of said carriage means;

edge detecting means, mounted on said carriage means, for detecting edges of said loaded paper;

paper bail mounted with at least first and second rollers rotatably and movably along said paper bail;

moving means for moving said paper bail between a pressing position for pressing and holding the loaded paper on a path of advance of said paper and a released position for releasing the paper from pressing;

a projection mounted on said carriage means for the engagement with said first and second rollers when said paper bail is moved to said released position, and for being disengaged from said first and second rollers when said paper bail is moved to said pressing position;

first memory means for storing the position of said carriage means, as detected by said position detecting means, when said edge detecting means detects a first side edge of said loaded paper;

second memory means for storing the position of said carriage means, as detected by said position detecting means, when said edge detecting means detects a second side edge of said loaded paper; and control means for controlling the movement of said carriage means and said paper bail such that said carriage means is first moved to detect first and second side edge of said loaded paper, and then by the combination of movements of paper bail and carriage means, first and second rollers are shifted at such positions as to come into contact with opposite side rim portions of said loaded paper.

2. A paper loading system as claimed in claim 1, further comprising a calculating means for calculating the width of said loaded paper by obtaining a difference between said first and second side edges.

3. A paper loading system as claimed in claim 2, further comprising third memory means for storing a table of different size papers with their width, so as to find a size of said loaded paper using said calculated width as a key factor.

4. A paper loading system as claimed in claim 1, wherein said carriage means is moved to approximately at a center of said platen before the paper is loaded, whereby said edge detecting means detects a top edge of said paper during the loading of said paper.

5. A paper loading system as claimed in claim 1, wherein said position detecting means comprises a belt having a plurality of stripes extending in the widthwise direction thereof and arranged in a predetermined pitch, said belt extending parallel to said platen, and a sensor means provided on said carriage means for sensing stripes during the movement of said carriage means.

6. A paper loading system as claimed in claim 1, wherein said edge detecting means comprises sensor means provided at an end of said projection located close to a path of advance of said paper for sensing the paper edge.

7. A paper loading system as claimed in claim 6, wherein said sensor means comprises a light emitting diode for emitting light towards said path of advance of said paper and a photocell for receiving a reflected light.

8. A paper loading system as claimed in claim 1, wherein said carriage carries an ink jet nozzle for effecting the print.

9. A paper loading system as claimed in claim 1, further comprising a fourth memory means for storing an approaching distance necessary to accelerate carriage from zero to a predetermined speed at which printing is carried out, thereby detecting a home position which is located away from the loaded paper with a spacing of said approaching distance from one side edge of said paper.

10. A paper loading system as claimed in claim 1, further comprising fifth memory means for storing the length of first and second rollers.

11. A paper loading system as claimed in claim 1, further comprising a spacer mounted on said paper bail between said first and second rollers so as to prevent said first and second rollers from being positioned side by side with no space therebetween, said spacer having a size smaller than any of said first and second rollers so as to avoid an engagement between said projection and said spacer.

12. A paper loading system as claimed in claim 11, further comprising fifth memory means for storing the length of first and second rollers and spacer.

13. A paper loading system as claimed in claim 1, further comprising sixth memory means for storing an initial position of rollers in which rollers are shifted to one end of said paper bail with a narrow space preserved for permitting the insertion of said projection between an end face of said rollers facing said one end of said paper bail and said one end of said paper bail.

* * * * *